US008449108B2

(12) United States Patent
Miller et al.

(10) Patent No.: US 8,449,108 B2
(45) Date of Patent: May 28, 2013

(54) METHOD AND SYSTEM FOR PROVIDING EVIDENCE OF PRINTING IN EVENT OF PRINT HEAD FAILURE

(75) Inventors: John P. Miller, Shelton, CT (US); David J. Eaton, Newtown, CT (US); Peter T. Collings, Shelton, CT (US); Lun Chan, New Fairfield, CT (US); Easwaran Nambudiri, Rye Brook, NY (US); James A. Salomon, Cheshire, CT (US)

(73) Assignee: Pitney Bowes Inc., Stamford, CT (US)

( * ) Notice: Subject to any disclaimer, the term of this patent is extended or adjusted under 35 U.S.C. 154(b) by 851 days.

(21) Appl. No.: 12/346,252

(22) Filed: Dec. 30, 2008

(65) Prior Publication Data

US 2010/0165066 A1 Jul. 1, 2010

(51) Int. Cl.
*B41J 2/01* (2006.01)
*B41J 3/00* (2006.01)

(52) U.S. Cl.
USPC ..... 347/107; 347/2; 347/4

(58) Field of Classification Search
USPC ..... 347/107, 2, 4, 104, 101
See application file for complete search history.

(56) References Cited

U.S. PATENT DOCUMENTS 5,502,304 A * 3/1996 Berson et al. ..... 250/271
5,525,798 A * 6/1996 Berson et al. ..... 250/271
5,611,630 A * 3/1997 Dolan et al. ..... 400/120.09
5,640,903 A 6/1997 Salomon
5,651,103 A 7/1997 Arsenault et al.
5,762,428 A 6/1998 Cordery et al.
5,769,550 A 6/1998 Brand et al.
5,806,421 A 9/1998 Dolan et al.
5,815,172 A 9/1998 Moh
5,829,895 A * 11/1998 Hayashi et al. ..... 400/124.05
6,039,257 A * 3/2000 Berson et al. ..... 235/468
6,502,912 B1 * 1/2003 Bernard et al. ..... 347/2
6,505,902 B1 * 1/2003 Teumer et al. ..... 347/8
6,895,395 B1 5/2005 Blanluet et al.
6,902,265 B2 * 6/2005 Critelli et al. ..... 347/101
7,431,419 B2 10/2008 Turner et al.
7,926,730 B2 * 4/2011 Auslander et al. ..... 235/494
2002/0105572 A1 * 8/2002 Testardi et al. ..... 347/107
2004/0001133 A1 * 1/2004 Critelli et al. ..... 347/101
2004/0096255 A1 5/2004 Jauert
2006/0023048 A1 * 2/2006 Mattern ..... 347/104

FOREIGN PATENT DOCUMENTS

EP 0605122 A2 6/1994

* cited by examiner

*Primary Examiner* — Stephen Meier
*Assistant Examiner* — Leonard S Liang
(74) *Attorney, Agent, or Firm* — Brian A. Lemm; Charles R. Malandra, Jr.; Steven J. Shapiro

(57) ABSTRACT

Systems and methods for providing evidence of printing in metering systems even in the event of a print head failure are provided. Along with generating a primary image for an indicium that evidences payment, a secondary image for the indicium, identical to a corresponding portion of the primary image but at a lower density, with physical boundaries that are within the boundaries of the primary image, is also generated. The primary image is printed by a first nozzle array, and the secondary image is printed by a second nozzle array. Because the primary image completely overlaps the secondary image, the secondary image is undetectable if the primary image is properly printed. The secondary image provides evidence of printing of the indicium that can be used to obtain a refund for the indicium in the event that the primary image was not printed due to failure of the first nozzle array.

11 Claims, 5 Drawing Sheets

METHOD AND SYSTEM FOR PROVIDING EVIDENCE OF PRINTING IN EVENT OF PRINT HEAD FAILURE

FIELD OF THE INVENTION

The invention disclosed herein relates generally to printing systems, and more particularly to systems and methods for providing evidence of printing in metering systems even in the event of a print head failure.

BACKGROUND OF THE INVENTION

Mail processing systems for printing postage indicia on envelopes and other forms of mail pieces have long been well known and have enjoyed considerable commercial success. There are many different types of mail processing systems, ranging from relatively small units that handle only one mail piece at a time, to large, multi-functional units that can process thousands of mail pieces per hour in a continuous stream operation. The larger mailing machines often include different modules that automate the processes of producing mail pieces, each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

Typically, one or more control devices, such as, for example, a microprocessor, performs user interface and controller functions for the mailing machine. Specifically, the control device provides all user interfaces, executes control of the mailing machine and print operations, calculates postage for debit based upon rate tables, provides the conduit for the Postal Security Device (PSD) to transfer postage indicia to the printer, operates with peripherals for accounting, printing and weighing, and conducts communications with a data center for postage funds refill, software download, rates download, and market-oriented data capture. The control device, in conjunction with an embedded PSD, constitutes the system meter that satisfies U.S. information-based indicia postage meter requirements and other international postal regulations regarding closed system meters. The United States Postal Service (USPS) initiated the Information-Based Indicia Program (IBIP) to enhance the security of postage metering by supporting new methods of applying postage to mail. The USPS has published draft specifications for the IBIP. The requirements for a closed system are defined in the "Performance Criteria for Information-Based Indicia and Security Architecture for Closed IBI Postage Metering System (PCIBI-C), dated Jan. 12, 1999. Part of the security required for postage metering systems includes the debiting of funds equivalent to the postage amount associated with a generated indicium, from the registers maintained within the PSD, upon printing of the indicium. The debiting occurs when the print operation is initiated, without regard to whether or not the printing has actually been completed.

The PCIBI-C specification defines the requirements for the indicium to be applied to mail produced by closed systems. An example of such an indicium is illustrated in FIG. 1. The indicium 10 consists of a two-dimensional (2D) barcode 12 and certain human-readable information 14. Some of the data included in the barcode can include, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Verification of an indicium is performed by the postal service scanning a mail piece to read the 2D barcode and verifying the information contained therein, including the digital signature. If the verification is unsuccessful, indicating that the indicium may not be authentic, the mail piece may not be delivered.

Since postal services accept indicia printed by postage meters and mailing machines as conclusive proof of payment of the amount of postage indicated, such devices are in effect machines for printing money. As a result postal services have imposed high standards for the print quality of indicia images produced by such machines. Even if an indicium is valid, if the verification equipment is unable to read the indicium, verification will not be possible. To avoid the loss of funds, postal services will provide refunds for "spoiled" mail pieces, i.e., mail pieces for which verification will not be possible or will not be mailed because of damage. Spoiled mail pieces can include mail pieces on which an indicium was properly printed but have been damaged prior to induction by the postal service (such as, for example, by being torn or mutilated in an inserting machine, sorting machine or the like) as well as mail pieces for which an indicium was attempted to be printed, but because of a malfunction of the printing device, was improperly printed and therefore would not be readable by automated equipment. In either situation, there must be some evidence of printing of an authentic indicium, i.e., an indicium that was properly generated and accounted for within the registers of the PSD. Such evidence is typically provided by the obtaining at least a portion of the indicium, e.g., one or more portions of the human readable portion or machine readable portion, such as the PSD serial number, values for the ascending and descending registers of the PSD, postage amount, and date of mailing, and verifying it with the records maintained by the PSD to confirm that the PSD did in fact generate the indicium.

In recent years, ink jet printing systems have been utilized in mail processing systems. Ink jet printing systems, as used herein, includes any form of printing wherein print control signals control a print mechanism to eject ink drops to produce a matrix of pixels, i.e. picture elements, to represent an image. An ink supply, typically in the form of a reservoir, supplies ink to the print mechanism. A problem with ink jet printing systems, however, is that they are susceptible to different kinds of failures, some of which are complete failures that can occur with no prior warning. An example of such a failure occurs in ink jet print heads that are not provided with a mechanism to release accumulated air within the print head. Ink jet print heads heat the ink to expel it from the nozzles of the print head. As the ink is heated, air bubbles are formed that accumulate internally within the print head. These air bubbles displace the ink provided to the nozzles. Failure to vent these air bubbles will eventually result in sufficient air pressure such that the print head will be denied ink, even if the reservoir is full. As such, none of the ink jet nozzles will be able to print, resulting in a total failure of the print head. This type of failure is unpredictable, and can occur suddenly without any warning, such as a gradual degradation of images previously printed.

For high speed mailing machines capable of processing mail pieces at rates of 18,000 letters per hour (300 letters per minute), a compete failure can result in the loss of postage funds at a rate of one to two dollars per second until the failure is noticed by an operator. Since there is a complete failure of the print head, there is no evidence of any kind that printing was attempted. The postal service, therefore, will not accept any mail pieces for delivery on which indicia, although properly generated and paid for, have not been printed, nor will the postal service provide any refund for the indicia that have been properly generated and paid for, but never printed, because of such a complete print head failure.

SUMMARY OF THE INVENTION

The present invention alleviates the problems associated with the prior art and provides systems and methods for providing evidence of printing in metering systems even in the event of a print head failure.

In accordance with embodiments of the present invention, along with generating a primary image for an indicium that evidences payment, and the corresponding image data required to print the primary image, a secondary image for the indicium, and the corresponding image data required to print the secondary image, are also generated. The secondary image will be identical to a corresponding portion of the primary image (whether it be the full indicium, only the human readable portion, or only the machine readable portion) but generated at a lower density of printing, with physical boundaries that are within the boundaries of the primary image so as not to interfere with the edge definition of the primary image. The primary image is printed by a first nozzle array, and the secondary image is printed by a second nozzle array. Because the primary image completely overlaps the secondary image, the secondary image will not be detected provided the primary image has been properly printed. The secondary image, printed by the second nozzle array, provides sufficient evidence of printing of the indicium such that the postal service may accept a mail piece for delivery, or at least to obtain a refund of the postage cost associated with the indicium in the event that the primary image was not printed due to failure of the first nozzle array selected to print the primary image.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 2:
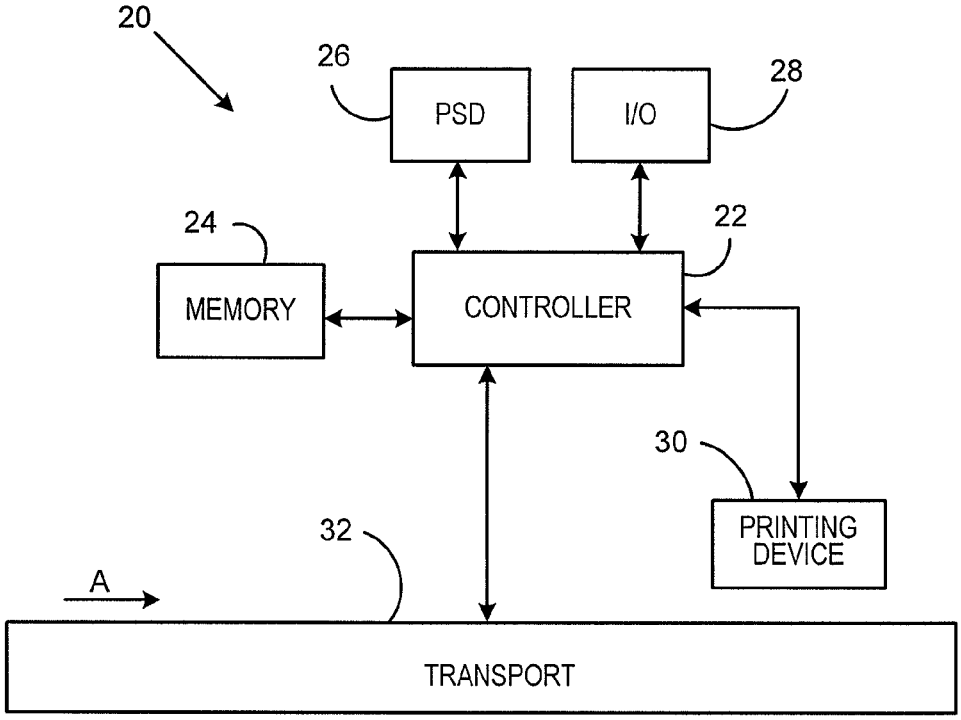
FIG. 2 illustrates in block diagram form a portion of a mail processing system according to an embodiment of the present invention.
Figure 3:
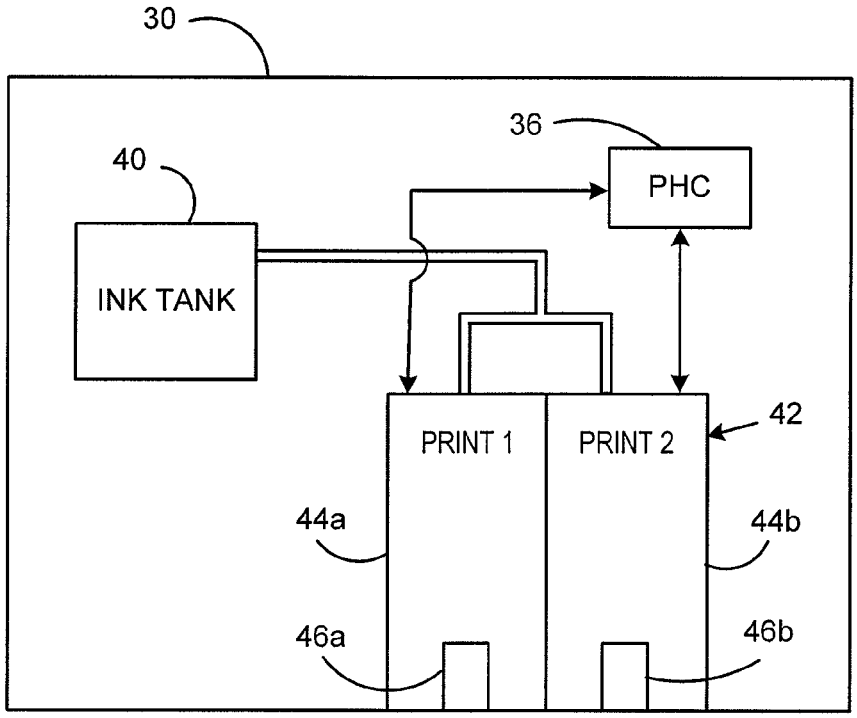
FIG. 3 illustrates in block diagram form an exemplary printing device of the mail processing system of FIG. 2.

In describing the present invention, reference is made to the drawings, wherein there is seen in FIG. 2 a portion of a mail processing system 20 according to an embodiment of the present invention. It should be noted that while the following description is being made with respect to a mail processing system, the present invention is not so limited and can be utilized in any type of metering system that prints indicia that evidences payment. Mail processing system 20 includes a controller 22, that preferably includes one or more controller units, such as, for example, a microprocessor, general or special purpose processor or the like, to control operation of the mail processing system 20. A memory 24 is coupled to the controller 22 for storage of data and executable software programs accessed by the controller 22. A postal security device (PSD) 26 is coupled to the controller. The PSD 26 contains one or more registers that store the accounting information concerning usage, such as, for example, an ascending register, descending register, piece count register, and the like. The PSD 26 generates the data required for an indicium. The controller 22, in conjunction with the PSD 26, provides the system meter that satisfies U.S. and international postal regulations regarding closed system information-based indicia postage (IBIP) meters. Controller 22 is coupled to one or more input/output devices 28, such as, for example, a keyboard and/or display unit for the input and output of various data and information. A printing device 30, described below with respect to FIG. 3, is coupled to controller 22. A transport 32, including, for example, rollers and/or belts, can be utilized to transport mail pieces through the mail processing system 20 in the direction indicated by arrow A based on signals provided from the controller 22. The transport 32 will transport the mail pieces past the printing device 30 such that printing can occur on each mail piece. Sensors (not shown) may located along the transport 32 to provide signals to the controller 22 to indicate the position of a mail piece on the transport 32.

FIG. 3 illustrates in block diagram form an exemplary printing device 30. Printing device 30 includes a print head controller (PHC) 36, which includes one or more processing devices, such as a microprocessor, ASIC, or the like, to control operation of the printing device based on data received from the controller 22. A print head 42 includes a first print mechanism (Print1) 44*a* and a second print mechanism (Print2) 44*b*. Each print mechanism 44*a*, 44*b* includes an array of respective nozzles 46*a*, 46*b*. Each mechanism 44*a*, 44*b* is supplied with ink from an ink tank 40. In response to commands received from the PHC 36, the print head 42 deposits ink onto a medium by expelling ink from one or more nozzles in the array of nozzles 46*a*, 46*b* to form an image on the medium. It should be noted that while FIG. 3 illustrates a single print head 42 with two mechanisms 44*a*, 44*b*, the single print head 42 could be replaced with two separate print heads that each have only a single mechanism. Thus, each mechanism 44*a*, 44*b* could be provided in a separate print head.

In operation, the controller 22, in conjunction with the PSD 26, will generate an image of an indicium to be printed on a mail piece, hereinafter referred to as the primary image. The image data for the primary image is sent from the controller 22 to the PHC 36, which then drives a selected one of the nozzle arrays 46*a*, 46*b* to print the primary image on the mail piece as the mail piece is transported by the transport 32 beneath the printing device 30. Typically, the nozzle array 46*a*, 46*b* selected to print the primary image is alternated between the two arrays, such that each array is utilized approximately the same amount. In conventional systems, the array that is not printing the primary image is deactivated during the printing of the primary image by the other array, and therefore does not perform a printing operation during that time. According to the present invention, the mail processing system 20 provides evidence of printing of the indicium in the event that the array 44*a*, 44*b* selected to print the primary image fails by utilizing the array 46*a*, 46*b* that is not selected to print the primary image to print a second, low density image that shadows the primary image (hereinafter referred to as the secondary image). The secondary image is identical to a corresponding portion of the primary image, except at a lower density as described below. The secondary image is applied directly on top of or beneath the primary image, depending on which array is printing the secondary image, and can only be detected in the event that the array printing the primary image fails. Thus, the redundancy provided by the secondary image, though inferior in print quality to the primary image, would provide an indication to the operator of a print head malfunction and a low level of proof that payment was properly made for an indicium. The secondary image may be sufficient for the postal service to accept and deliver the mail, or used to obtain a refund of the postage funds deducted for the indicium that was not properly printed.

Figure 4:
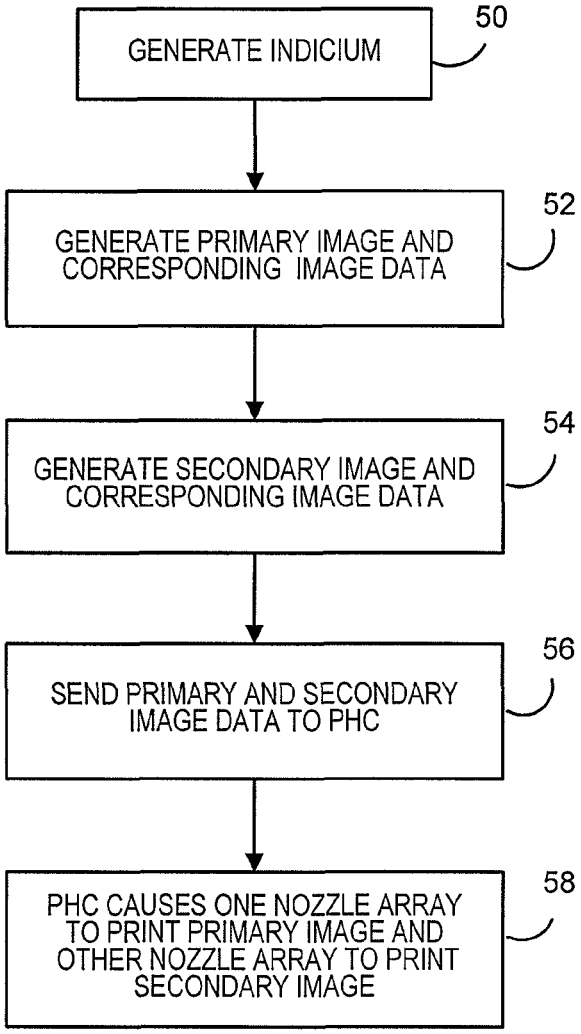
FIG. 4 illustrates in flow chart form an example of the processing of mail pieces performed by the mail processing system of FIG. 2.

FIG. 4 illustrates in flow diagram form the processing performed by the mail processing system 20. As a mail piece is being transported through the system 20, the controller 22, in conjunction with the PSD 26, generates an indicium that evidences payment of the postage for the mail piece in step 50. In step 52, the controller 22 generates a primary image for the indicium, and the corresponding image data required to print the primary image. Thus, the image data for the primary image data includes the data necessary to print the full indicium image, such as the indicium 10 illustrated in FIG. 1, in a resolution and density as required to ensure the readability of the indicium by automatic verification equipment. In step 54, the controller 22 generates a secondary image for the indicium, and the corresponding image data required to print the secondary image. The secondary image, while being of the same resolution as the primary image, is generated at a lower density than the primary image, with physical boundaries that are within the boundaries of the primary image so as not to interfere with the edge definition of the primary image. The secondary image may include the complete indicium, or only a portion of the complete indicium, e.g., only the machine readable barcode portion (or some portion thereof) without the human readable portion or only the human readable portion (or some portion thereof) without the machine readable barcode portion. Thus, the secondary image will be identical to the corresponding portion of the primary image (whether it be the full indicium, the human readable portion, or the machine readable portion) but at a lower density of printing. In step 56, the controller 22 sends the primary image data and the secondary image data to the PHC36 of the printing device 30. In step 58, the PHC 36, based on the image data received from the controller, causes the primary image and secondary image to be printed by controlling one of the nozzle arrays 46*a*, 46*b* to print the primary image and the other of the nozzle arrays 46*a*, 46*b* to print the secondary image. The primary image will be printed on the mail piece first and the secondary image printed on top of the primary image if the mail piece passes under the nozzle array selected to print the primary image first and then under the nozzle array selected to print the secondary image. Conversely, the secondary image will be printed first (and beneath the primary image) and the primary image printed on top of the secondary image if the mail piece passes under the nozzle array selected to print the secondary image first and then under the nozzle array selected to print the primary image.

Figure 1:
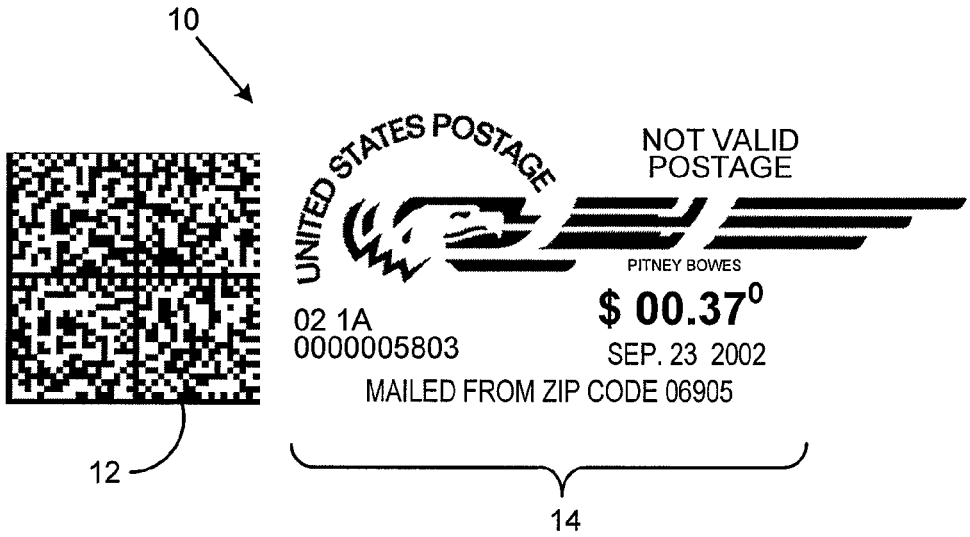
FIG. 1 ( PRIOR ART )
FIG. 1 illustrates an example of an indicium that meets the IBIP specifications.
Figure 5A:
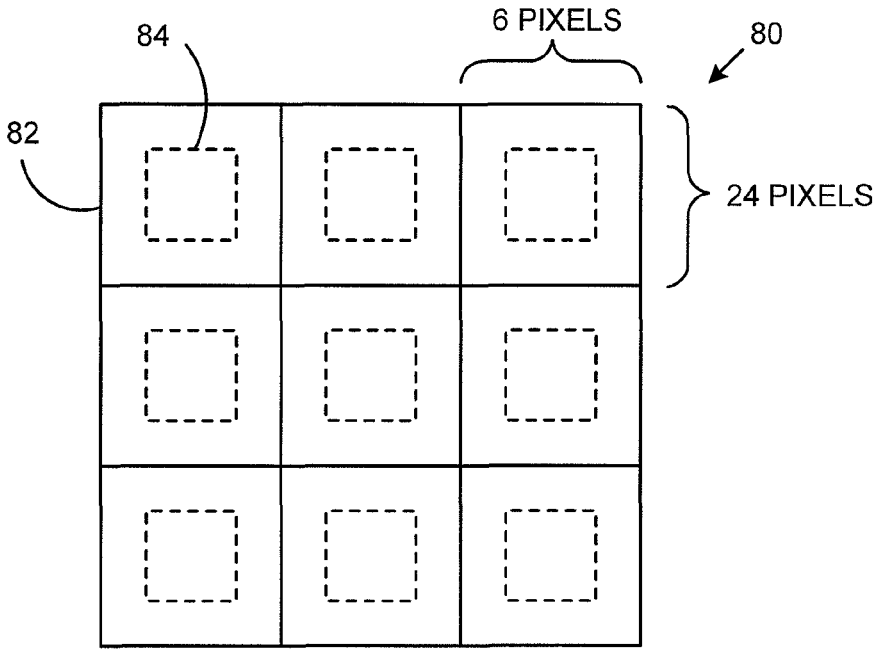
FIGS. 5A-5C show a portion of a barcode to illustrate the first and second images according to an embodiment of the present invention.
Figure 5B:
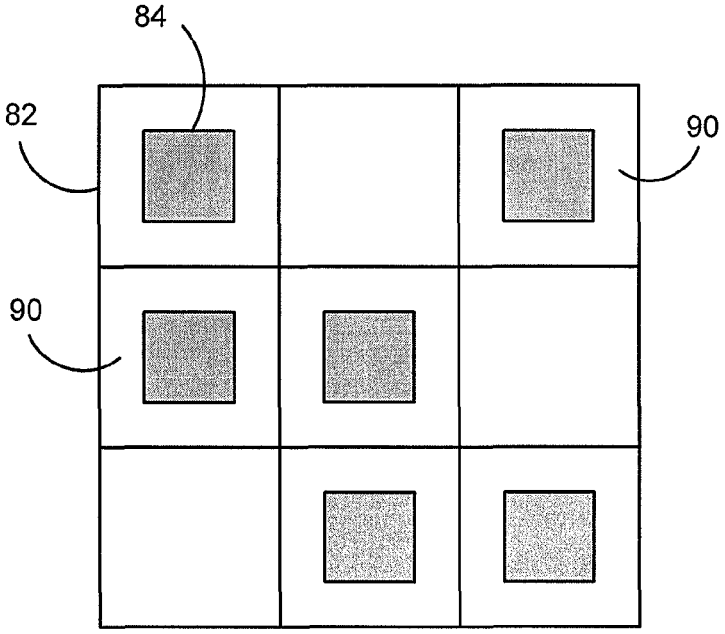
Figure 5C:
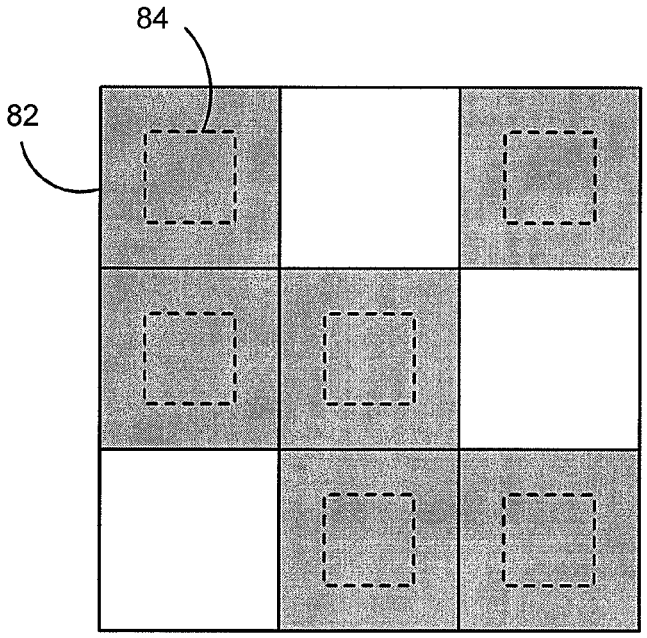

FIGS. 5A-5C show a portion 80 of a machine readable barcode that illustrates the concept of the first and second images generated as described above. Specifically, FIG. 5A illustrates a 3×3 block of cells 82 that are contained within the barcode of an indicium, such as barcode 12 illustrated in FIG. 1. Typically, the barcode 12, as illustrated in FIG. 1, is comprised of a 40×40 block of cells. Each cell includes 144 pixels, arranged in a block that is 6 pixels long by 24 pixels high. When a cell is to be filled, i.e., printed, the PHC 36 will cause the print head 42 to expel a drop of ink into each of the 144 pixels of the cell, thereby completely filling the cell. Thus, if a cell 82 is to be printed in the primary image, the image data will include data for printing every pixel within the cell 82. The secondary image generated by the controller 22 is, as described above, generated at a lower density than the primary image, with physical boundaries that are within the boundaries of the primary image so as not to interfere with the edge definition of the primary image. For each of the cells 82 illustrated in FIG. 5A, the secondary image is denoted by the dashed lines 84. Thus, if a cell 82 is to be printed in the secondary image, the PHC 36 will cause the print head 42 to expel a drop of ink into each of the pixels within the dashed lines 84 in each cell. For example, the printed area could be reduced around each edge of each cell 82 by two pixels, thus making each cell include only 40 pixels arranged in a block that is 2 pixels long by 20 pixels high. FIG. 5B shows the barcode portion 80 with some of the cells printed based on the secondary image. As shown in FIG. 5B, there is a gap 90 around each of the printed areas in the cells 82 that are printed, which results from the decreased density at which each cell 82 is printed. It should be noted that the gap 90 need not be provided around all edges in the cells 82, nor does the gap 90 need to be uniform around each edge. Such non-uniformity may be caused, for example, due to drop placement uncertainty caused by encoding errors as the mail piece is transported under the print head 42.

FIG. 5C shows the barcode portion 80 with some of the cells 82 printed based on the primary image. As shown in FIG. 5C, each of the cells 82 desired to be printed is completely filled, as they are printed at full density. Because the primary image completely overlaps the secondary image, the primary image conceals the secondary image and the secondary image will not be detected provided the primary image has been properly printed. As noted above, the secondary image can either be printed first, beneath the primary image, or the secondary image can be printed second, on top of the primary image. While the secondary image as illustrated in FIG. 5B may not be sufficient for complete verification of the indicium, e.g., it may not include the complete indicium, it may still be accepted by the postal authority, and at least provides evidence of printing of the indicium necessary to obtain a refund of the postage cost associated with the indicium in the event that the primary image (as illustrated in FIG. 5C) was not printed due to failure of the nozzle array selected to print the primary image.

If the secondary image includes a human readable portion, the secondary image includes the same information as the primary image but in a lower density as described above. Thus, for example, if alphanumeric characters contained within the primary image are printed at a specified density of pixels, the secondary image includes the same alphanumeric characters printed at a lower density. Accordingly, the primary image will overlap the secondary image, and the secondary image will be visible only in the event that the primary image is not printed.

It should be noted that the generating and printing of the secondary image is performed to provide some evidence of printing an indicium in the case of a complete failure of printing of the primary image. As noted above, failure due to a vapor lock of the array of nozzles of a print mechanism is very unpredictable, and can occur without warning. However, such failures will typically not occur within the first half of an expected life cycle of a print mechanism. Thus, while the generating and printing of the secondary image can occur for every single indicium generated by the controller 22, it may be desirous to only perform such generating and printing of the secondary image after some predetermined amount of print cycles, based on the expected life span of the print mechanism. In this manner, ink can be conserved by not unnecessarily printing the secondary image when the likelihood of it being utilized is minimal.

While preferred embodiments of the invention have been described and illustrated above, it should be understood that these are exemplary of the invention and are not to be considered as limiting. Those skilled in the art will recognize that various additions, deletions, substitutions, and other modifications can be made without departing from the spirit or scope of the present invention. Accordingly, the invention is not to be considered as limited by the foregoing description of the preferred embodiments but is defined by the appended claims and their equivalents.

What is claimed is:

1. A method for printing an indicium comprising:

generating a primary image for the indicium;

generating a secondary image for at least a portion of the indicium, the secondary image being identical to a corresponding portion of the primary image except having a lower density than the primary image;

printing the primary image using a first nozzle array on a medium; and printing the secondary image at the lower density using a second nozzle array on the medium, wherein the primary image, when successfully printed, will conceal the secondary image on the medium.

2. The method of claim 1, wherein the at least a portion of the indicium includes a machine readable barcode.

3. The method of claim 1, wherein the at least a portion of the indicium includes a human readable portion.

4. The method of claim 1, wherein the first and second nozzle arrays are part of a single print head.

5. The method of claim 1, wherein the indicium is a postage indicium and the medium is a mail piece.

6. The method of claim 1, wherein the primary image is printed before the secondary image is printed.

7. The method of claim 1, wherein the primary image is printed after the secondary image is printed.

8. A mail processing system comprising:

a metering device configured to generate data for an indicium for a mail piece;

a processing device, coupled to the metering device, configured to generate a primary image for the indicium and a secondary image for at least a portion of the indicium, the secondary image being identical to a corresponding portion of the primary image except having a lower density than the primary image;

a first nozzle array to print the primary image on the mail piece; and a second nozzle array to print the secondary image on the mail piece, wherein the primary image, when successfully printed, will conceal the secondary image on the mail piece.

9. The mail processing system of claim 8, wherein the at least a portion of the indicium includes a machine readable barcode.

10. The mail processing system of claim 8, wherein the at least a portion of the indicium includes a human readable portion.

11. The mail processing system of claim 8, wherein the first nozzle array and second nozzle array are part of a single print head.

* * * * *